US007219853B2

(12) United States Patent
Williams

(10) Patent No.: US 7,219,853 B2
(45) Date of Patent: May 22, 2007

(54) SYSTEMS AND METHODS FOR TRACKING TARGETS WITH AIMPOINT OFFSET

(75) Inventor: Darin S. Williams, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 334 days.

(21) Appl. No.: 10/874,065

(22) Filed: Jun. 21, 2004

(65) Prior Publication Data

US 2007/0040061 A1 Feb. 22, 2007

(51) Int. Cl.

| | |
|---|---|
| ***F41G 7/00*** | (2006.01) |
| *G01S 13/00* | (2006.01) |
| *G01S 7/40* | (2006.01) |
| *G01S 17/00* | (2006.01) |

(52) U.S. Cl. ..... 244/3.14; 244/3.1; 244/3.11; 244/3.15; 244/3.16; 244/3.19; 89/1.11; 342/61; 342/62; 342/165; 342/173; 342/175; 342/195

(58) Field of Classification Search ..... 244/3.1–3.3; 382/103, 106, 107; 342/61–64, 165–175, 342/195; 89/1.11

See application file for complete search history.

(56) References Cited

U.S. PATENT DOCUMENTS

| | | | | |
|---|---|---|---|---|
| 4,179,088 A * | 12/1979 | French | 244/3.19 |
| 4,243,187 A * | 1/1981 | Esker | 244/3.13 |
| 4,492,166 A * | 1/1985 | Purcell | 244/3.22 |
| 4,565,339 A * | 1/1986 | Lonnoy et al. | 244/3.13 |
| 5,064,140 A * | 11/1991 | Pittman et al. | 244/3.13 |
| 5,071,087 A * | 12/1991 | Gray | 244/3.15 |
| 5,082,200 A * | 1/1992 | Gray | 244/3.15 |
| 5,082,201 A * | 1/1992 | Le Bars et al. | 244/3.16 |
| 5,826,819 A * | 10/1998 | Oxford | 244/3.14 |
| 5,878,977 A * | 3/1999 | Hosaka et al. | 244/3.13 |
| 6,889,934 B1 * | 5/2005 | Thomas et al. | 244/3.19 |

* cited by examiner

*Primary Examiner*—Bernarr E. Gregory
(74) *Attorney, Agent, or Firm*—Horace St. Julian; Leonard A. Alkov; Karl A. Vick

(57) ABSTRACT

A target identification and tracking system includes a carrier vehicle and one or more tracking vehicles. The carrier vehicle may determine an aimpoint of a target from a high resolution image of the target and may generate an offset from a tracking point to the aimpoint. The offset may be conveyed to an assigned tracking vehicle for tracking the tracking point of the target while navigating toward the aimpoint of the target. The tracking point may be the target's centroid. The carrier vehicle may employ a high-resolution LIDAR imaging system to identify the aimpoint from a target's features; while the tracking vehicle may employ a lower resolution optical imaging system for tracking the target's tracking point. The carrier vehicle may correct the offset for parallax and the offset may be revised as the tracking vehicle approaches the target.

34 Claims, 4 Drawing Sheets

SYSTEMS AND METHODS FOR TRACKING TARGETS WITH AIMPOINT OFFSET

TECHNICAL FIELD

Embodiments of the present invention pertain to imaging systems and to target identification systems. Some embodiments pertain to missile defense systems.

BACKGROUND

Target identification and tracking systems that employ a number of tracking vehicles to track and/or destroy targets generally require high resolution imaging to identify a specific aimpoint on a target that differs from the target's centroid. It may be desirable to track an aimpoint on a target, rather than a centroid, because the lethality of the tracking vehicle can be improved, resulting in reduced cost, size, and/or weight. Some conventional target identification systems use long-wave (LW) diffraction techniques to identify and/or track a target. The resolution of these long-wave diffraction techniques is limited by aperture size and wavelength, among other things, making these techniques impractical for small tracking vehicles, such as miniature kill vehicles, to track a target's aimpoint other than a centroid.

Some higher resolution systems that use shorter wavelengths for imaging may have better diffraction limits for tracking a separate aimpoint, but have a limited passive acquisition range and may require external illumination to acquire targets. Some lower resolution systems that track a target's centroid do not need high resolution because they do not identify a separate aimpoint. These lower resolution systems may require the tracking vehicles to have a higher kill radius. This may result in heavier and/or more expensive tracking vehicles.

Thus, there are general needs for methods and target tracking systems that can track a target's aimpoint that's offset from the centroid with smaller tracking vehicles.

SUMMARY

A target identification and tracking system includes a carrier vehicle and one or more tracking vehicles. The carrier vehicle may determine an aimpoint of a target from an image of the target and may generate an offset from a tracking point to the aimpoint. The offset may be conveyed to an assigned tracking vehicle for tracking the tracking point of the target while navigating toward the aimpoint of the target. The tracking point may be the target's centroid. The carrier vehicle may employ a high-resolution LIDAR imaging system to identify the aimpoint from a target's features; while the tracking vehicle may employ a lower resolution optical imaging system for tracking the target's tracking point. The carrier vehicle may correct the offset for parallax and the offset may be revised as the tracking vehicle approaches the target.

BRIEF DESCRIPTION OF THE DRAWINGS

The appended claims are directed to some of the various embodiments of the present invention. However, the detailed description presents a more complete understanding of embodiments of the present invention when considered in connection with the figures, wherein like reference numbers refer to similar items throughout the figures and:

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. The scope of embodiments of the invention encompasses the full ambit of the claims and all available equivalents of those claims. Such embodiments of the invention may be referred to, individually or collectively, herein by the term "invention" merely for convenience and without intending to voluntarily limit the scope of this application to any single invention or inventive concept if more than one is in fact disclosed.

Figure 1:
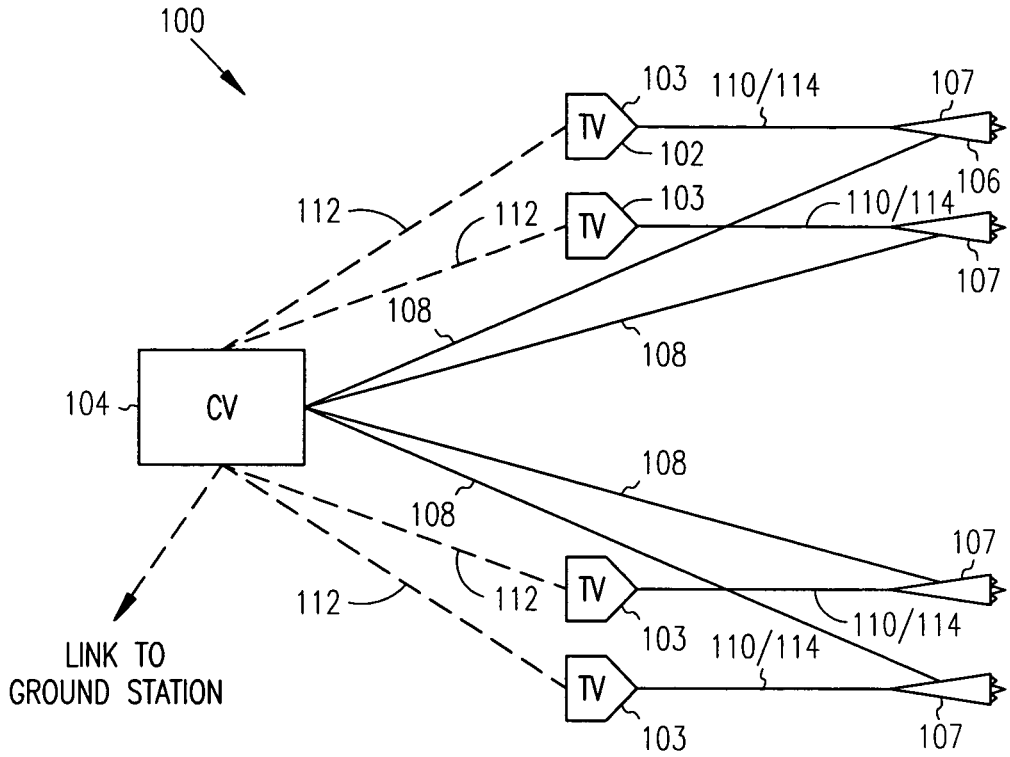
FIG. 1 illustrates a target identification and tracking system in accordance with some embodiments of the present invention.

FIG. 1 illustrates a target identification and tracking system in accordance with some embodiments of the present invention. Target identification and tracking system 100 may include carrier vehicle 104 and a plurality of tracking vehicles 103 to track one or more targets 107. In some embodiments, tracking vehicles may be kill vehicles, such as miniature kill vehicles, and targets 107 may be enemy missiles or warheads, although the scope of the invention is not limited in this respect.

In accordance with some embodiments, carrier vehicle 104 generates an offset from a tracking point from an image of target 106, and at least one of tracking vehicles 103 (e.g., tracking vehicle 102) tracks the tracking point of target 106 while navigating toward an aimpoint of target 106 based on the offset. The aimpoint may be determined from the offset and the tracking point. The offset may be provided by the carrier vehicle. In some embodiments, the tracking point of a target may be a centroid of the target, although the scope of the invention is not limited in this respect. Accordingly, tracking vehicles 103 only require sufficient resolution to track a tracking point rather than an aimpoint.

Figure 2:
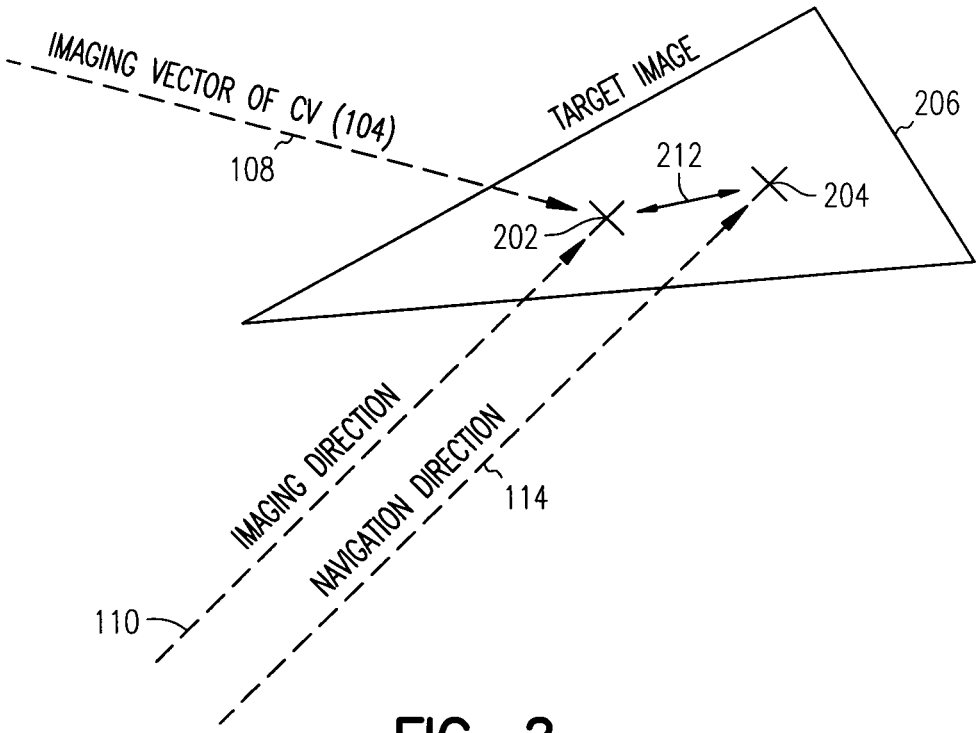
FIG. 2 illustrates the tracking of a target in accordance with some embodiments of the present invention.

FIG. 2 illustrates the tracking of a target in accordance with some embodiments of the present invention. Referring to FIGS. 1 and 2 together, in accordance with some embodiments, carrier vehicle 104 may generate image 206 of target 106, and may determine aimpoint 204 based on characteristics of image 206. Carrier vehicle 104 may further determine offset 212 to aimpoint 204 from tracking point 202. Carrier vehicle 104 may then convey offset 212 to tracking vehicle 102.

In some embodiments, carrier vehicle 104 may correct the offset for parallax based on a position of the tracking vehicle 102 and a position of the carrier vehicle 104. In some embodiments, the parallax correction may take into account the differing views seen by the carrier vehicle (e.g., from direction 108) and the assigned tracking vehicle (e.g., from direction 110). In these embodiments, the offset may be translated between the offset seen by the carrier vehicle to an offset that would be seen by the tracking vehicle. Carrier vehicle 104 may convey the parallax corrected offset to tracking vehicle 102.

In some embodiments, offset 212 may comprise a distance and a direction from tracking point 202 to aimpoint 204. In some embodiments, offset 212 comprises a magnitude and an angle relative to tracking point 202. In some embodiments, tracking point 202 may be a centroid of the target 106. In some embodiments, the centroid may be the center of mass of the target as determined from a two-dimensional image (e.g., without range of the target) generated by carrier vehicle 104. This is described in more detail below.

In some embodiments, carrier vehicle 104 initially identifies a target, tracks tracking point 202, and directs a high-resolution laser-imaging sensor (e.g., LIDAR) at the tracked target to generate image 206. Image 206 may be a high-resolution three-dimensional (3D) image comprising a two-dimensional (2D) image of pixels with ranging information for at least some of the pixels. In these embodiments, tracking point 202 may already be known when carrier vehicle 104 generates image 206 of the target 106. In these embodiments, carrier vehicle 104 may already be tracking target 106 when it generates the image 206 of target 106.

In some embodiments, carrier vehicle 104 may track an intensity weighted centroid of target 106, which may more closely match a natural tracking point of the target. In these embodiments the intensity of image data (e.g., pixels) may be taken into account to weight the centroid of a tracked target, although the scope of the invention is not limited in this respect.

In some embodiments, carrier vehicle 104 may determine aimpoint 204 by resolving the image including extracting features from the image. The features may include shape, orientation and/or size of the target, although the scope of the invention is not limited in this respect, as other features may also be used to determine the aimpoint for a particular target.

In some embodiments, carrier vehicle 104 and tracking vehicles 103 may use a common reference frame, such as a common inertial reference frame, which may specify the direction of the aimpoint offset in a plane perpendicular to the tracking vehicle's line-of-sight. In these embodiments, offset 212 may be provided to the tracking vehicle relative to their common reference frame. In these embodiments, tracking vehicles 103 and carrier vehicle 104 may be able to track the tracking point of the targets relative to the same reference frame, reducing errors therebetween.

In some embodiments, tracking vehicle 102 may revise offset 212 while navigating toward the target. Offset 212 may change with respect to the tracking point as the tracking vehicle approaches the target. A revised inertial vector for navigating to aimpoint 204 based on a revised offset may be determined to allow tracking vehicle 102 to continue in a direction toward aimpoint 204. In some embodiments, carrier vehicle 104 may determine the revised offset and may send the revised/updated offset to tracking vehicle 102 as tracking vehicle 102 navigates toward target 106, although the scope of the invention is not limited in this respect.

In some embodiments, carrier vehicle 104 may track a tracking point of each of a plurality of targets 107 and may generate an image of each of targets 107 with a high-resolution laser-imaging system. In these embodiments, carrier vehicle 104 may determine an aimpoint based on characteristics of the images for each of targets 107, and may determine an offset to the aimpoint from a tracking point for each of the targets. In these embodiments, carrier vehicle 104 may assign one of the tracking vehicles to each of the targets (e.g., based on proximity) for possible interception and may convey an associated one of the offsets to the assigned tracking vehicle 102. In some embodiments, carrier vehicle 104 may convey information to tracking vehicles 102 over links 112, which may be RF links or laser/optical links, although the scope of the invention is not limited in this respect. In some embodiments, each of the assigned tracking vehicles may track the tracking point of an associated target while navigating toward the aimpoint of that target based on the associated offset.

In some embodiments, tracking vehicles 103 may use a passive optical imaging system to navigate toward the target. In some embodiments, the passive optical imaging system may provide sufficient resolution to determine the tracking point; however the passive optical imaging system may provide insufficient resolution to determine the aimpoint, although the scope of the invention is not limited in this respect. In this way, the imaging system may receive images from imaging direction 110 with the navigation system may direct the tracking vehicle in navigation direction 114.

In some embodiments, targets 107 may be moving rapidly in space external to earth's atmosphere (i.e., in the exo-atmosphere). In some embodiments, targets 107 may be enemy missiles or enemy warheads. In some embodiments, system 100 may track and destroy one or more of targets 107. In some embodiments, tracking vehicles 103 may comprise kinetic energy kill vehicles, miniature kill vehicles, explosive kill vehicles, space vehicles or spacecraft, guided missiles, and/or guided projectiles, although the scope of the invention is not limited in this respect. In some embodiments, tracking vehicles 103 may detonate within a predetermined kill-radius of the aimpoint of a target or at impact with the target. In other embodiments, tracking vehicles 103 may attempt to destroy a target by impact with the target. In these embodiments, the aimpoint may be a lethal spot on the target and may be determined based on the target's vulnerability as well as the potential for damage that may be inflicted by the particular type of tracking vehicle, although the scope of the invention is not limited in this respect. For example, on certain types of targets, the aimpoint may be a predetermined distance back from the front or nose of the target.

In some embodiments, carrier vehicle 104 may be an interceptor booster, although the scope of the invention is not limited in this respect. In some embodiments, carrier vehicle 104 may release one or more of tracking vehicles 103 after identifying one or more of targets 107. In some embodiments, carrier vehicle 104 may release tracking vehicles 103 when within a predetermined range of targets 107. In these embodiments, tracking vehicles 103 may be provided tracking information (e.g., the tracking points) of the targets prior to their release, although in other embodiments, the tracking information may be provided after their release. In some embodiments, tracking vehicles 103 may be released after carrier vehicle 104 processes images of the targets and determines their aimpoint. In these embodiments, tracking vehicles 103 may be provided with the offset information as well as the tracking points of the targets prior to being released, although the scope of the invention is not limited in this respect.

Figure 3:
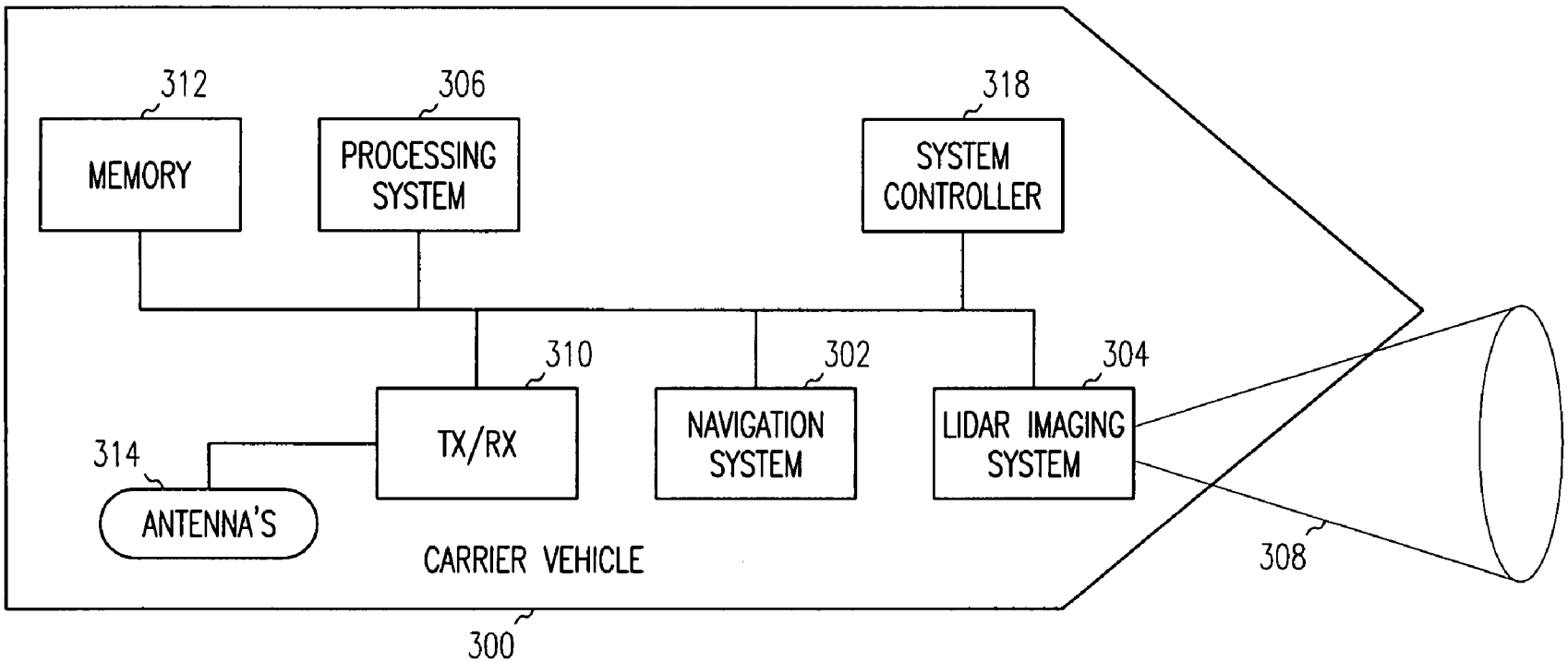
FIG. 3 is a functional block diagram of a carrier vehicle in accordance with some embodiments of the present invention.

FIG. 3 is a functional block diagram of a carrier vehicle in accordance with some embodiments of the present invention. Carrier vehicle 300 may be suitable for use as carrier vehicle 104 (FIG. 1), although other vehicles may also be suitable. Carrier vehicle 300 includes imaging system 304 to generate an image of a target, processing system 306 to determine an aimpoint based on characteristics of the image and to determine an offset to the aimpoint from a tracking point of the target. In these embodiments, carrier vehicle 300 may also include transmitter 310 to convey the offset to a tracking vehicle. When operating as part of system 100 (FIG. 1), imaging system 304 may generate image 206 (FIG. 2) of target 106 (FIG. 1), processing system 306 may determine aimpoint 204 (FIG. 2) based on characteristics of image 206 (FIG. 2) and may determine offset 212 (FIG. 2) to aimpoint 204 (FIG. 1) from tracking point 202 (FIG. 2). Transmitter 310 may convey offset 212 (FIG. 2) to tracking vehicle 102 (FIG. 1).

In some embodiments, processing system 306 may correct the offset for parallax based on a position of a tracking vehicle and a position of carrier vehicle 300. Transmitter 310 may be used to convey the corrected offset to the tracking vehicle. In some embodiments, processing system 306 revises the parallax corrected offset as the tracking vehicle navigates toward the target, and transmitter 310 sends the revised offset to the tracking vehicle as it closes in on the target.

In some embodiments, imaging system 304 may be a high-resolution imaging system, such as a laser-radar (LIDAR) system for generating a three-dimensional (3D) image of one or more targets. In some embodiments, the three-dimensional image may comprise a two-dimensional (2D) image of pixels with ranging information for at least some of the pixels, although the scope of the invention is not limited in this respect. In some embodiments, imaging system 304 may have field-of-regard (FOR) 308 that may include the plurality of targets 103 (FIG. 1).

In some embodiments, processing system 306 may include a feature extractor for use in determining the aimpoint of a particular target by resolving the image and extracting features from the image. The features may include shape, orientation and/or size of the target, although other features may also be used to determine the aimpoint.

In some embodiments, transmitter 310 may be a radio-frequency (RF) transmitter for communicating with tracking vehicles 103 (FIG. 1) with antennas 314 over links 112 (FIG. 1). In some embodiments, carrier vehicle 300 may also include navigation system 302 for navigating, and system controller 318 to manage and control the overall operation of carrier vehicle 300. In some embodiments, carrier vehicle 300 may include memory 312 for use by processing system 306. In these embodiments, processing system 306 may resolve an image of a target, the feature extractor may extract features from the image, and the resolved image and any extracted features may be compared to images and/or features stored in memory 312 to determine the aimpoint. In some embodiments, aimpoints for various target types may be stored in memory 312 and may be based on the type of target identified, although the scope of the invention is not limited in this respect.

Although carrier vehicle 300 is illustrated as having several separate functional elements, one or more of the functional elements may be combined and may be implemented by combinations of software-configured elements, such as processing elements including digital signal processors (DSPs), and/or other hardware elements. For example, some elements may comprise one or more microprocessors, DSPs, application specific integrated circuits (ASICs), and combinations of various hardware and logic circuitry for performing at least the functions described herein.

Figure 4:
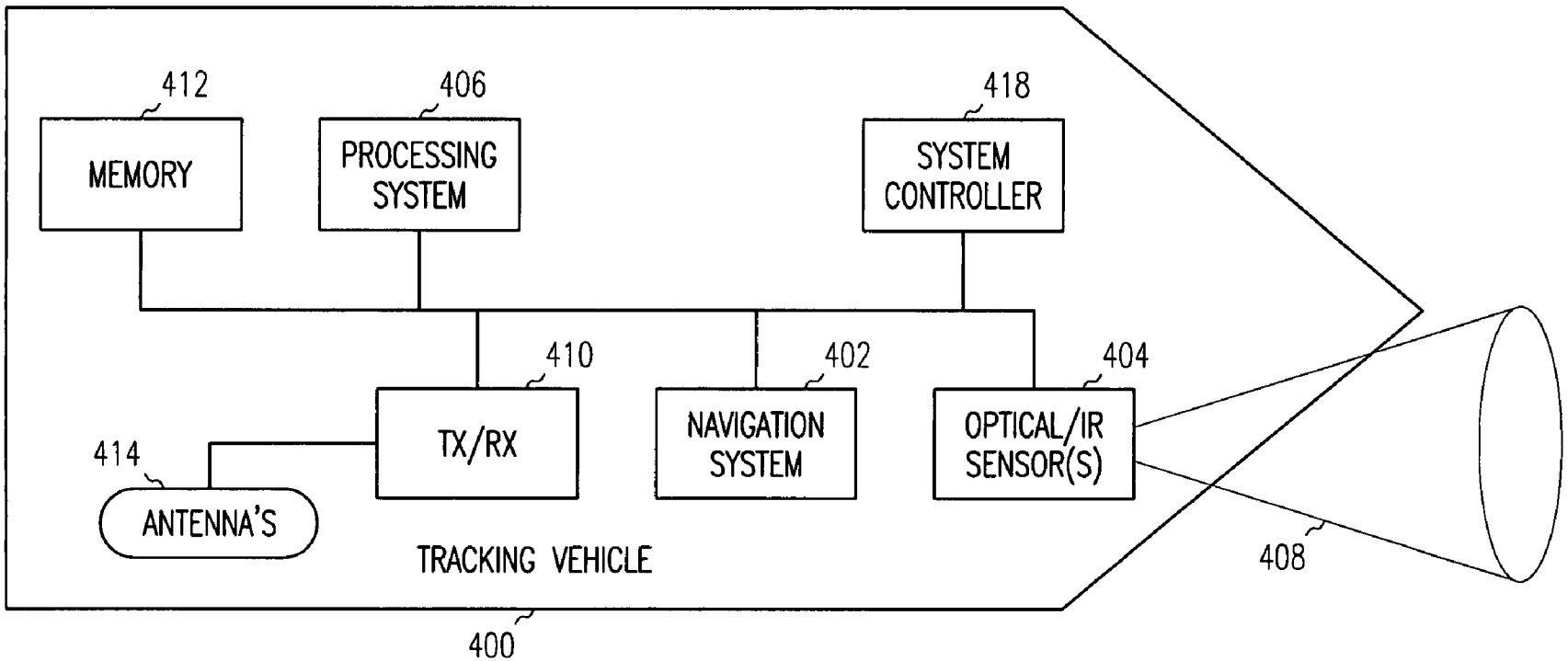
FIG. 4 is a functional block diagram of a tracking vehicle in accordance with some embodiments of the present invention.

FIG. 4 is a functional block diagram of a tracking vehicle in accordance with some embodiments of the present invention. Tracking vehicle 400 may be suitable for use as one or more of tracking vehicles 103 (FIG. 1), although other tracking vehicles may also be suitable. Tracking vehicle 400 comprises sensor system 404 to generate images of a target, and navigation system 402 to navigate toward an aimpoint of a target. In some embodiments, tracking vehicle 400 may include processing system 406 to operate in conjunction with sensor system 404 to determine the tracking point of a target. In some embodiments, the aimpoint may be determined from an offset received from a carrier vehicle.

In some embodiments, processing system 406 may determine direction 210 (FIG. 2) to the tracking point from an image of the target and may generate an inertial vector in direction 114 (FIG. 2) based on offset 212 (FIG. 2) for use by navigation system 402 in navigating toward aimpoint 204 (FIG. 2). In some embodiments, the offset may comprise a distance and a direction from the tracking point to the aimpoint and the tracking point may comprise the centroid of the target, although the scope of the invention is not limited in this respect.

In some embodiments, sensor system 404 may comprise a passive optical sensor system. In some embodiments, sensor system 404 may include a passive infrared sensor to receive infrared images of a target, although the scope of the invention is not limited in this respect. In some embodiments, sensor system 404 may have sufficient resolution to identify the tracking point of a target, but may have insufficient resolution to separately identify the aimpoint of a target, although the scope of the invention is not limited in this respect. In some embodiments, sensor system 404 may have field-of-view (FOV) 408, which may be directed toward particular one or more targets.

In some embodiments, tracking vehicle 400 may be substantially autonomous after being released from a carrier vehicle. In these embodiments, processing system 406 may revise the offset while navigating toward the aimpoint of a target as a range between the tracking vehicle and the target changes. The offset may need to be revised because the offset may change as the tracking vehicle approaches the target. In some embodiments, processing system 406 may revise the offset based on the target range and/or velocity, which may be provided by the carrier vehicle, although the scope of the invention is not related in this respect.

In some embodiments, tracking vehicle 400 may further comprise receiver 410 and one or more antennas 414 to receive communications from a carrier vehicle including offset 212 (FIG. 2). In some embodiments, tracking vehicle 400 may be less autonomous after being released from a carrier vehicle. In these embodiments, receiver 410 may be used to receive one or more revised offsets from a carrier vehicle while navigating toward the aimpoint as a range between the tracking vehicle and the target changes. In some embodiments, tracking vehicle 400 may also include system controller 418 to manage and control the operations of tracking vehicle 400. In some embodiments, tracking vehicle 400 may also comprise memory 412 to store information, such as the offset as well as other information, for use by the elements of tracking vehicle 400.

Although tracking vehicle 400 is illustrated as having several separate functional elements, one or more of the functional elements may be combined and may be implemented by combinations of software-configured elements, such as processing elements including digital signal processors (DSPs), and/or other hardware elements. For example, some elements may comprise one or more microprocessors, DSPs, application specific integrated circuits (ASICs), and combinations of various hardware and logic circuitry for performing at least the functions described herein.

Figure 5:
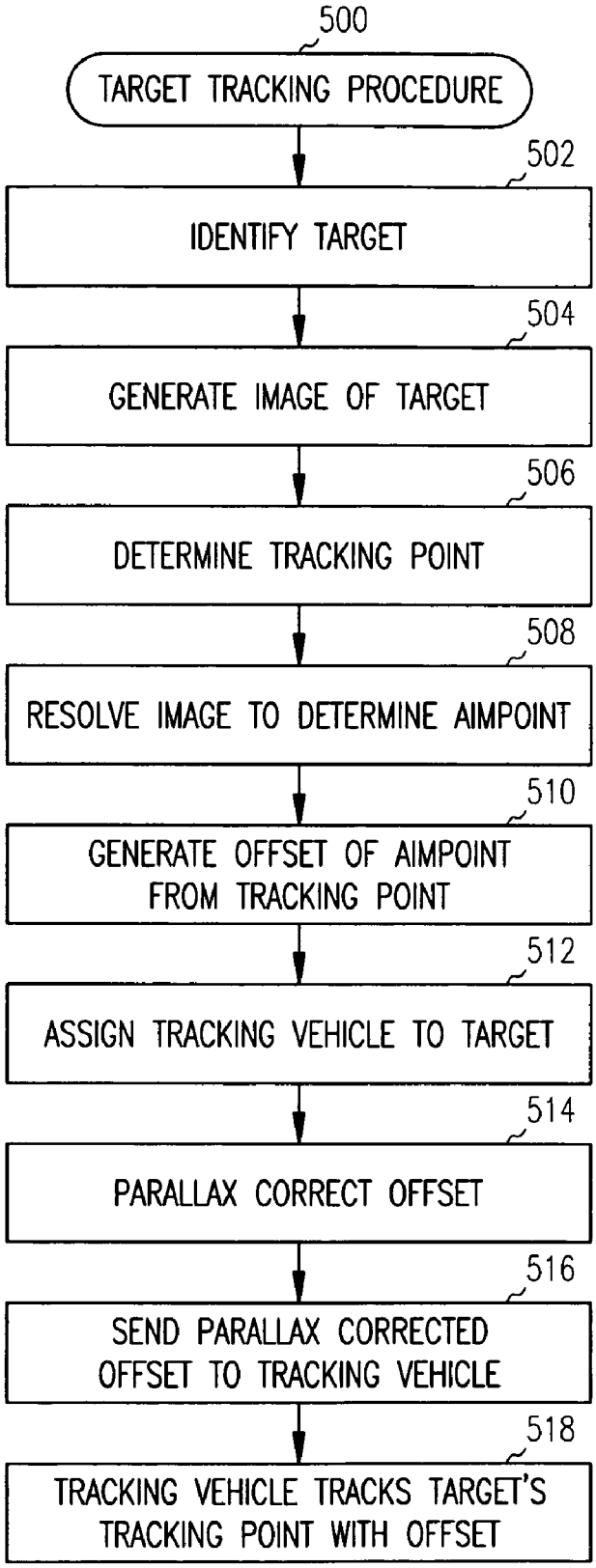
FIG. 5 is a flow chart of a target tracking procedure in accordance with some embodiments of the present invention.

FIG. 5 is a flow chart of a target tracking procedure in accordance with some embodiments of the present invention. Target tracking procedure 500 may be used by a target identification and tracking system to identify and track one or more targets with one or more tracking vehicles. In some embodiments, target tracking procedure 500 may be used by target identification and tracking system 100 (FIG. 1) to identify and track one or more targets 107 (FIG. 1) with one or more tracking vehicles 103 (FIG. 1).

Operation 502 comprises identifying one or more targets. In some embodiments, a carrier vehicle may initially identify one or more targets from either a plurality of targets and non-targets, and/or from the background. At this point, the targets may be unresolved and their features may not be distinguishable, although the scope of the invention is not limited in this respect. In some embodiments, operation 502 may comprise the carrier vehicle tracking one or more of the identified targets.

Operation 504 comprises generating a high resolution image of a target. In some embodiments, operation 504 comprises generating a three-dimensional (3D) image of the one or more targets with an active laser radar imaging system. The three-dimensional (3D) image may comprise a two-dimensional (2D) image of pixels with ranging information for at least some of the pixels. In some embodiments, operation 504 comprises directing a laser-imaging sensor at a tracked target to generate the high resolution image.

Operation 506 comprises determining a tracking point of a target. In some embodiments, the tracking point may be a centroid and may be determined from low resolution images of the target, although the scope of the invention is not limited in this respect. In some embodiments, the tracking point of the target may be determined from the high resolution image generated in operation 504.

Operation 508 comprises resolving the high resolution image to determine an aimpoint. In some embodiments, operation 508 comprises extracting features from the high resolution image including shape, orientation and/or size of the target to determine the aimpoint.

Operation 510 comprises generating an offset from the tracking point. The offset may comprise a distance and a direction from the tracking point to the aimpoint.

Operation 512 comprises assigning a tracking vehicle to the target. In some embodiments, a tracking vehicle may be assigned to a target based on its proximity to the target. In some embodiments, operation 512 may be performed at any time after a target is identified in operation 502. In some embodiments, one or more tracking vehicles may be released from the carrier vehicle after a target is identified, although the scope of the invention is not limited in this respect. In some embodiments, the carrier vehicle may also track the targets after they are identified.

Operation 514 comprises correcting the offset determined in operation 510 for parallax. Operation 514 may correct the offset for parallax based on a position of the carrier vehicle and a position of an assigned tracking vehicle.

Operation 516 comprises sending the parallax-corrected offset to the tracking vehicle. In some embodiments, the parallax-corrected offset may be sent from the carrier vehicle to the tracking vehicle over an RF link.

In operation 518, a tracking vehicle tracks a target's tracking point while it navigates toward the offset. In some embodiments, operation 518 comprises tracking a centroid of the target, which may be the tracking point. In some embodiments, the offset may be updated as the tracking vehicle approaches the target. In some embodiments, the tracking vehicle may update the offset, while in other embodiments; the carrier vehicle may update the offset and send the updated offset to the tracking vehicle.

In some embodiments, operation 502 through operation 516 may be performed by a carrier vehicle, while operation 518 may be performed by a tracking vehicle. Although the individual operations of procedure 500 are illustrated and described as separate operations, one or more of the individual operations may be performed concurrently, and nothing requires that the operations be performed in the order illustrated.

Embodiments of the invention may be implemented in one or a combination of hardware, firmware and software. Embodiments of the invention may also be implemented as instructions stored on a machine-readable medium, which may be read and executed by at least one processor to perform the operations described herein. A machine-readable medium may include any mechanism for storing or transmitting information in a form readable by a machine (e.g., a computer). For example, a machine-readable medium may include read-only memory (ROM), random-access memory (RAM), magnetic disk storage media, optical storage media, flash-memory devices, electrical, optical, acoustical or other form of propagated signals (e.g., carrier waves, infrared signals, digital signals, etc.), and others.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention lies in less than all features of a single disclosed embodiment. Thus the following claims are hereby incorporated into the detailed description, with each claim standing on its own as a separate preferred embodiment.

What is claimed is:

1. A method for tracking one or more targets comprising:

generating an image of a target;

determining a tracking point of the target based on the image;

determining an aimpoint of the target based on characteristics of the image;

determining an offset to the aimpoint from the tracking point; and conveying the offset to a tracking vehicle.

2. The method of claim 1 wherein generating the image, determining the aimpoint, and determining the offset are performed by a carrier vehicle, the carrier vehicle being separate from the tracking vehicle, and wherein the method further comprises:

correcting the offset for parallax based on a position of the tracking vehicle and a position of the carrier vehicle, and wherein conveying comprises conveying the corrected offset to the tracking vehicle.

3. The method of claim 1 wherein the offset comprises a distance and a direction from the tracking point to the aimpoint.

4. The method of claim 3 wherein the tracking point is a centroid of the target.

5. The method of claim 1 further comprising:

initially identifying the target;

tracking a centroid of the target, the centroid being the tracking point; and directing a laser-imaging sensor at the tracked target to generate the image.

6. The method of claim 1 wherein generating comprises generating a three-dimensional (3D) image of the one or more targets with an active laser radar system, the three-dimensional (3D) image comprising a two-dimensional (2D) image of pixels with ranging information for at least some of the pixels.

7. The method of claim 6 wherein determining the aimpoint comprises resolving the image including extracting features from the image, the features including at least one of shape, orientation and size of the target.

8. The method of claim 1 further comprising the tracking vehicle tracking the tracking point of the target while navigating toward the aimpoint based on the offset.

9. The method of claim 8 further comprising the tracking vehicle revising the offset during the tracking and the navigating as a range between the tracking vehicle and the target changes.

10. The method of claim 8 further comprising the tracking vehicle receiving a revised offset from a carrier vehicle during the tracking and the navigating as a range between the tracking vehicle and the target changes.

11. The method of claim 8 wherein generating the image, determining the aimpoint, determining the offset, and conveying the offset are performed by a carrier vehicle.

12. The method of claim 1 further comprising:

tracking a tracking point of each of a plurality of targets;

generating an image of each of the targets with a laser-imaging system;

determining an aimpoint based on characteristics of the image for each of the targets;

determining an offset to the aimpoint from the tracking point for each of the targets;

assigning one of a plurality of tracking vehicles to each of the targets for interception; and conveying an associated one of the offsets to the assigned tracking vehicle.

13. The method of claim 12 wherein each of the assigned tracking vehicles track the tracking point of the associated target while navigating toward the aimpoint of the associated target based on the associated offset, the tracking vehicles using a passive optical imaging system to track the associated target.

14. The method of claim 13 wherein the targets are moving rapidly external to earth's atmosphere.

15. The method of claim 13 wherein the tracking vehicles comprise at least one of kinetic energy kill vehicles, miniature kill vehicles, explosive kill vehicles, space vehicles or spacecraft, guided missiles, or guided projectiles.

16. A target tracking system comprising:

at least one tracking vehicle; and a carrier vehicle comprising an imaging system to generate an image of a target, a processing system to determine a tracking point of the target based on the image and to generate an offset from the tracking point to an aimpoint, and a transmitter to provide the offset to at least one tracking vehicle, wherein the at least one tracking vehicle includes a processing system to determine the aimpoint on the target based on the tracking point and the offset and to track the tracking point of the target while navigating toward the aimpoint.

17. The system of claim 16 wherein the processing system of the carrier vehicle corrects the offset for parallax based on a position of the tracking vehicle and a position of the carrier vehicle, and wherein the transmitter of the carrier vehicle conveys the corrected offset to the tracking vehicle.

18. The system of claim 16 wherein the offset comprises a distance and a direction from the tracking point to the aimpoint, and wherein the tracking point is a centroid of the target.

19. The system of claim 16 wherein the processing system of the carrier vehicle initially identifies the target, tracks the tracking point, and directs a high-resolution laser-imaging sensor at the tracked target to generate a high resolution image of the target, the image being a three-dimensional (3D) image comprising a two-dimensional (2D) image of pixels with ranging information for at least some of the pixels.

20. The system of claim 16 wherein the processing system of the carrier vehicle determines the aimpoint by resolving the image including extracting features from the image, the features including at least one of shape, orientation and size of the target.

21. The system of claim 16 wherein the processing system of the tracking vehicle revises the offset while navigating toward the target.

22. The system of claim 16 wherein the processing system of the carrier vehicle revises the offset and the transmitter sends a revised offset to the tracking vehicle as the tracking vehicle navigates toward the target.

23. A carrier vehicle comprising:

an imaging system to generate an image of a target;

a processing system to determine a tracking point of the target based on the image, to determine an aimpoint of the target based on the image and to determine an offset to the aimpoint from the tracking point; and a transmitter to convey the offset to a tracking vehicle.

24. The carrier vehicle of claim 23 wherein the processing system corrects the offset for parallax based on a position of the tracking vehicle and a position of the carrier vehicle, and wherein the transmitter is to convey the corrected offset to the tracking vehicle.

25. The carrier vehicle of claim 24 wherein the processing system revises the parallax-corrected offset as the tracking vehicle navigates toward the target, and wherein the transmitter sends the revised offset to the tracking vehicle as it closes in on the target.

26. The carrier vehicle of claim 23 wherein the imaging system is a laser-radar (LIDAR) system for generating a high resolution three-dimensional (3D) image of the one or more targets, the three-dimensional (3D) image comprising a two-dimensional (2D) image of pixels with ranging information for at least some of the pixels.

27. The carrier vehicle of claim 23 wherein the processing system includes a feature extractor for use in determining the aimpoint by resolving the image and extracting features from the image, the features including at least one of shape, orientation and size of the target.

28. A tracking vehicle comprising:

a passive optical sensor system to generate an image for use in determining a tracking point of a target; and a navigation system to navigate toward an aimpoint of a target, the aimpoint being determined from an offset from the tracking point to the aimpoint, wherein the offset is received from a carrier vehicle.

29. The tracking vehicle of claim 28 further comprising a processing system to determine a direction to the aimpoint based on the offset, and to generate an inertial vector for use by the navigation system in navigating toward the aimpoint, wherein the offset comprises a distance and a direction from the tracking point to the aimpoint, and wherein the tracking point is a centroid of the target.

30. The tracking vehicle of claim 28 wherein the sensor system comprises a passive infrared sensor to receive infrared images of the target.

31. The tracking vehicle of claim 30 wherein the tracking vehicle comprises a kill vehicle, and either:

detonates within a predetermined kill-radius of the aimpoint of the target or at impact with the target.

32. The tracking vehicle of claim 28 further comprising a receiver to receive the offset from a carrier vehicle, the offset being a parallax corrected offset.

33. The tracking vehicle of claim 32 wherein the processing system revises the offset while navigating toward the aimpoint as a range between the tracking vehicle and the target changes.

34. The tracking vehicle of claim 32 wherein the receiver receives a revised offset from the carrier vehicle while navigating toward the aimpoint as a range between the tracking vehicle and the target changes.

* * * * *